US009258638B2

(12) United States Patent
Colich

(10) Patent No.: US 9,258,638 B2
(45) Date of Patent: Feb. 9, 2016

(54) ANTI-DIFFRACTION AND PHASE CORRECTION STRUCTURE FOR PLANAR MAGNETIC TRANSDUCERS

(71) Applicant: Audeze LLC, Costa Mesa, CA (US)

(72) Inventor: Dragoslav Colich, Huntington Beach, CA (US)

(73) Assignee: Audeze LLC, Costa Mesa, CA (US)

( * ) Notice: Subject to any disclaimer, the term of this patent is extended or adjusted under 35 U.S.C. 154(b) by 0 days.

(21) Appl. No.: 14/517,696

(22) Filed: Oct. 17, 2014

(65) Prior Publication Data

US 2015/0110326 A1 Apr. 23, 2015

Related U.S. Application Data

(60) Provisional application No. 61/892,417, filed on Oct. 17, 2013.

(51) Int. Cl.

| | |
|---|---|
| ***H04R 9/06*** | (2006.01) |
| ***H04R 1/34*** | (2006.01) |
| ***H04R 9/02*** | (2006.01) |
| ***H04R 9/04*** | (2006.01) |
| ***H04R 3/00*** | (2006.01) |
| ***H04R 7/04*** | (2006.01) |

(52) U.S. Cl.

CPC ..... *H04R 1/345* (2013.01); *H04R 3/00* (2013.01); *H04R 7/04* (2013.01); *H04R 9/025* (2013.01); *H04R 9/047* (2013.01); *H04R 2201/34* (2013.01)

(58) Field of Classification Search

CPC ..... H04R 9/02; H04R 9/025; H04R 9/047; H04R 9/048; H04R 7/04; H04R 7/14; H04R 2209/024; H04R 1/345; H04R 3/00; H04R 2201/34

USPC ..... 381/399, 408, 412, 414, 421, 431, 162, 381/343, 160, 340, 342; 181/170, 155, 156

See application file for complete search history.

(56) References Cited

U.S. PATENT DOCUMENTS

| | | | | |
|---|---|---|---|---|
| 3,164,686 | A * | 1/1965 | Tibbetts | 381/399 |
| 4,550,228 | A | 10/1985 | Walker et al. | |
| 5,195,143 | A * | 3/1993 | Spiegel et al. | 381/399 |
| 5,325,439 | A * | 6/1994 | Smiley | 381/399 |
| 7,224,817 | B2 | 5/2007 | Kosuda | |
| 8,014,545 | B2 | 9/2011 | Grant et al. | |
| 8,223,977 | B2 | 7/2012 | Watanabe | |

OTHER PUBLICATIONS

International Search Report and Written Opinion dated Feb. 4, 2015 for PCT/US2014/061246, 7 pgs.

* cited by examiner

*Primary Examiner* — Huyen D Le

(74) *Attorney, Agent, or Firm* — Robert D. Becker; Manatt, Phelps & Phillips

(57) ABSTRACT

An anti-diffraction plate for including in a planar magnetic transducer. The anti-diffraction plate includes anti-diffraction structures for positioning adjacent to magnets of the planar magnetic transducer. By introducing a shape over top surface of the magnets, the anti-diffraction structures cause the elimination of diffraction patterns as a main audio wavefront passes by the magnets from a diaphragm. A diffusion structure for diffusing reflected sound waves, the diffusion structures reducing or eliminating the power and capacity of the reflected sound waves to create interference patterns with oncoming sound waves.

10 Claims, 6 Drawing Sheets

ANTI-DIFFRACTION AND PHASE CORRECTION STRUCTURE FOR PLANAR MAGNETIC TRANSDUCERS

CROSS-REFERENCE TO RELATED APPLICATIONS

This application claims the benefit of U.S. Provisional Patent Application No. 61/892,417, filed Oct. 17, 2013, the entirety of which is incorporated by reference as if fully set forth herein.

FIELD OF THE INVENTION

The present invention generally relates to acoustic devices, and more particularly, to an anti-diffraction and phase correction structure for a planar magnetic transducer.

BACKGROUND OF THE INVENTION

Planar magnetic transducers use a flat, lightweight diaphragm suspended in a magnetic field rather than a cone attached to a voice coil. The diaphragm in a planar magnetic transducer includes a conductive circuit pattern that, when energized, creates forces that move the diaphragm in the magnetic field to produce sound.

The structures encountered by a sound wave traveling from the diaphragm are obstacles that may negatively interfere with the sound wave. It is desirable for a sound wave as emitted from a diaphragm to encounter as little interference as possible as it travels from the diaphragm.

BRIEF SUMMARY OF PREFERRED EMBODIMENTS OF THE INVENTION

Preferred embodiments of the invention include a planar magnetic transducer that minimizes diffraction of the main sound wave, minimizes the effects of reflected sound waves and minimizes the phase distortion.

A preferred embodiment of the invention includes a planar magnetic transducer having one or more anti-diffraction structures positioned adjacent to one or more magnets for eliminating diffraction of a sound wave around the magnets, the sound wave emitted from a diaphragm and passing by the magnets.

A preferred embodiment of the invention includes a planar magnetic transducer having one or more diffusion structures positioned adjacent to one or more magnets for minimizing reflections of the sound wave.

A preferred embodiment of the invention includes a planar magnetic device having one or more wave guides positioned adjacent to one or more magnets for creating a uniform wavefront.

BRIEF DESCRIPTION OF THE DRAWINGS

Preferred embodiments of the present invention are illustrated by way of example, and not by way of limitation, in the figures of the accompanying drawings and in which like reference numerals refer to similar elements and in which.

DETAILED DESCRIPTION OF PREFERRED EMBODIMENTS OF THE INVENTION

Planar magnetic transducers comprise a flat, lightweight diaphragm suspended in a magnetic field. A structure of magnets coupled to stator plates are arranged at a distance from the diaphragm to effect the magnetic field. The diaphragm in a planar magnetic transducer includes a conductive circuit pattern that, when energized, creates forces that move the diaphragm in the magnetic field to produce sound.

A sound wave emitted from a diaphragm and traveling through air in a planar transducer will encounter the magnetic structure and stator plate as obstructions in its path of travel. The obstructions may cause the user to hear distortions in the sound, depending on the particular wavelength of the sound wave. If the wavelength of the sound wave is longer then the width of the obstruction, then the wave generally passes through without distortion.

If the wavelength is of comparable size to the obstruction, diffraction patterns are formed, causing distortions to the sound wave. When the diffracted waves and the main sound wave arrive at the listener's ears at the same time, distortion of the sound occurs and the stereo imaging is affected. When sound waves go around the obstacle they arrive at the listener's ear at slightly different times compared to the main sound wave, causing phase distortion.

If the wavelength is smaller than the obstruction, then in addition to diffraction patterns, the sound wave is reflected. The reflected sound waves interact with new sound waves emitting from the diaphragm to create constructive and destructive interference patterns at certain frequencies, causing further distortion. Further, the space between the obstructions can create resonant chambers which influence frequency response.

Preferred embodiments of the invention include a planar magnetic transducer that minimizes diffraction of the main sound wave, minimizes the effects of reflected sound waves and minimizes the phase distortion. A preferred embodiment of the invention includes an anti diffraction structure that can be considered as a particular version of a wave guide planar magnetic transducer having one of more wave guides positioned adjacent to one or more magnets.

Figure 1:
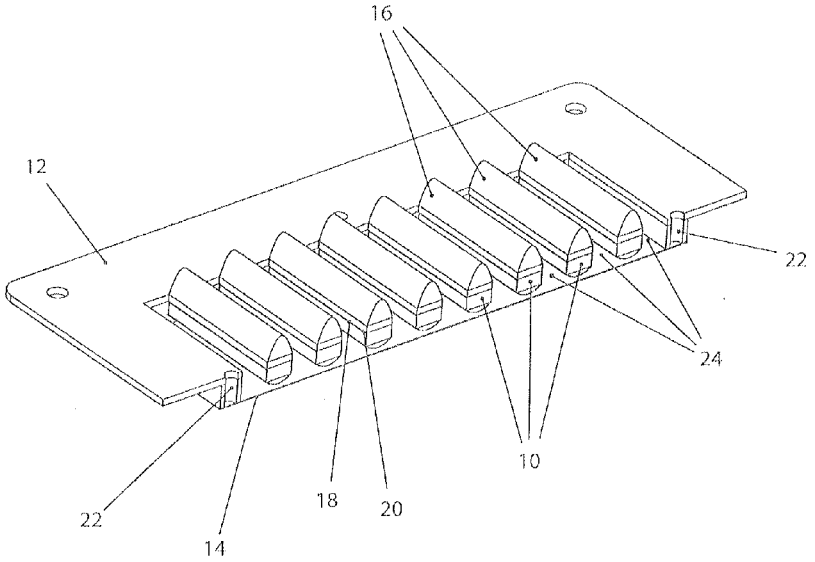
FIG. 1 is a cross-section perspective view of portions of an anti-diffraction planar magnetic transducer constructed in accordance with some embodiments.
Figure 2:
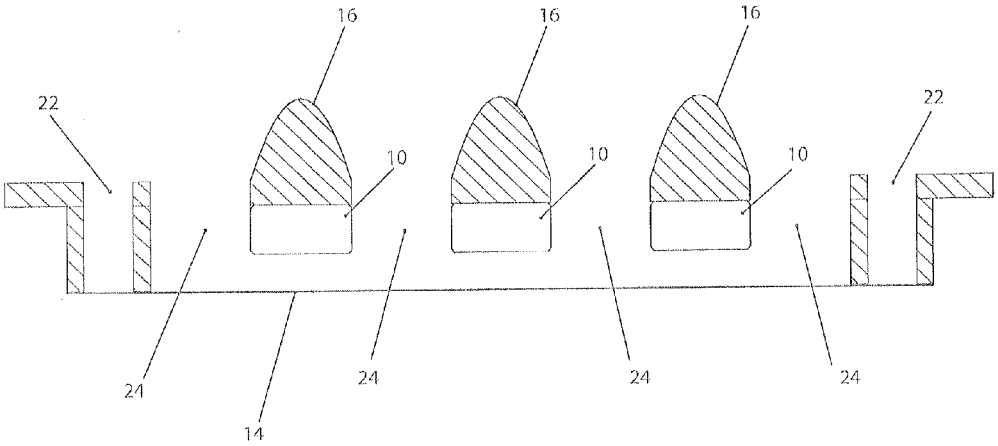
FIG. 2 is a cross-section elevation view of portions of the anti-diffraction planar magnetic transducer as shown in FIG. 1.
Figure 3:
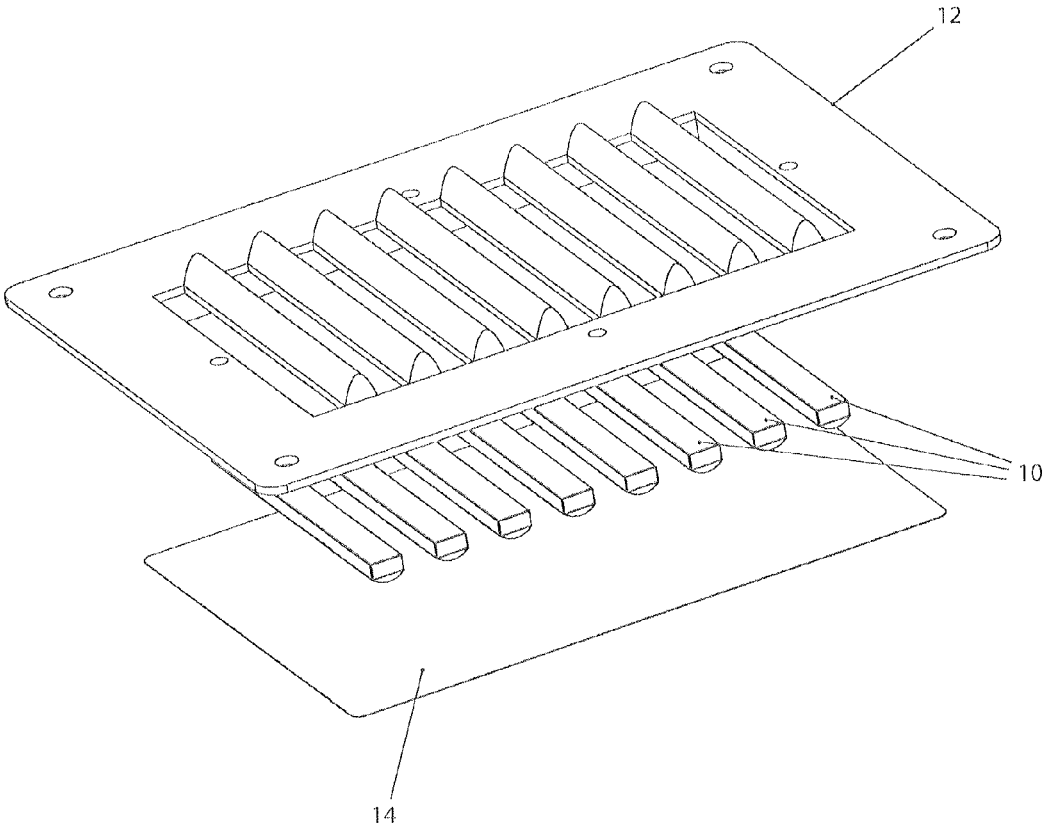
FIG. 3 is an exploded perspective view of portions the anti-diffraction planar magnetic transducer constructed in accordance with some embodiments.

FIGS. 1-3 show various views of portions of a planar magnetic transducer according to some embodiments. FIG. 1 illustrates a perspective and cut-away, section view, and FIG. 2 illustrates the cut-away portion in a front elevation view. As assembled in the planar magnetic device, FIG. 1 shows an array of magnets 10 positioned adjacent to one side of an anti-diffraction plate 12, the anti-diffraction plate having one or more anti-diffraction structures 16. In some embodiments, the anti-diffraction structures 16 are aligned with array of magnets 10 such that each bottom side edge of an anti-diffraction structure is flush with each top side edge of a magnet. For example, edge 18 of an anti-diffraction structure is flush with edge 20 of a magnet of array 10. In the device, a diaphragm 14 is mounted such that diaphragm 14 is spaced at a distance from array of magnets 10 to be within the magnetic field of array 10 when the planar magnetic device is assembled. For example, rivets may be introduced into holes 22 to mount diaphragm 14 at an appropriate distance. Other mounting techniques may be used to achieve the suspension of diaphragm 14 without departing from the spirit of the invention. Anti-diffraction plate 12 further comprises one or more gaps or apertures between anti-diffraction structures 16 for allowing sound waves traveling from diaphragm 14 to pass by plate 12.

One of the primary objectives of preferred embodiments is to create a uniform wavefront that results in much smoother frequency response, better imaging, smoother phase response, better high frequency extension and higher efficiency. Anti-diffraction plate 12 eliminates the resonant chambers in front of the diaphragms and creates an acoustic chamber with higher pressure. Higher pressure creates a better acoustical impedance match between diaphragm and air increasing the efficiency of the transducer and creates better high frequency extension. Anti-diffraction plate 12 can be used with standard long bar magnets to achieve the reduction in diffraction in a cost-effective way.

FIG. 2 illustrates a front elevation cut-away view of the structures show in FIG. 1, according to some embodiments. As shown, array of magnets 10 are disposed over diaphragm 14. An anti-diffraction structure of the plurality of anti-diffraction structures 16 of anti-diffraction plate 12 is positioned adjacent to each of the magnets in array 10. Gaps or apertures 24 and mounts 22 are also shown.

Referring to FIGS. 1 and 2, the shape of the top surface an anti-diffraction structure of the plurality of anti-diffraction structures 16 is a shape that minimizes or eliminates diffraction of a sound wave traveling from diaphragm 14 as the sound wave passes by the magnets and plate. While FIGS. 1 and 2 show a particular shape for the anti-diffraction structures, it is understood by those of ordinary skill in the art that any shape capable of eliminating or maximizing the reduction of diffraction of the sound wave emanating from diaphragm 14 is contemplated as being within the scope of embodiments of the invention. Cross-sectional shapes of the anti-diffraction structure includes but are not limited to exponential, elliptical, parabolic, hyperbolic, or conical profiles.

Further, while anti-diffraction plate 12 is shown in a particular configuration and as a circular shape, and while array 10 is shown with three magnets of a particular shape, size or configuration, it is understood that variations on the structures, including different quantity, shape, and dimensions of array 10 and anti-diffraction plate 12, are within the scope of the embodiments of the invention.

FIG. 3 illustrates an exploded view of array of magnets 10, anti-diffraction plate 12, and diaphragm 14 according to some embodiments. Array 10, plate 12, and diaphragm 14 are components of a planar magnetic transducer (not shown).

Anti-diffraction plate 12 may be constructed from any suitably rigid material that will not interfere with the magnetic forces of the magnets, including plastic, metal, or composite materials. In a preferred embodiment, anti-diffraction plate 12 is made of a rigid plastic material mounted adjacent to magnet array 10. Long bar magnets are spaced in parallel, in alignment with the anti-diffraction structures 16 of plate 12. The shape of each anti-diffraction structure comprises a flat bottom surface, and a curved top surface.

Figure 4:
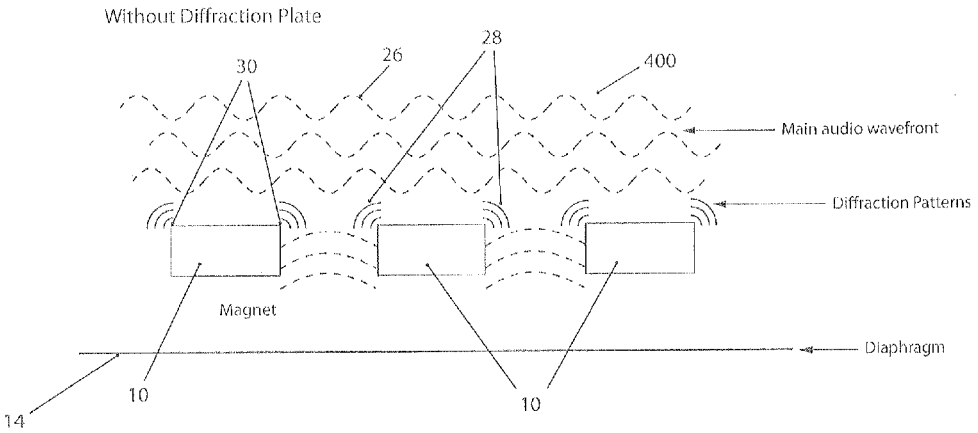
FIG. 4 is a diagram showing a comparison between the movement and diffraction of sound waves without any anti-diffraction plate, and with the anti-diffraction plate constructed in accordance with some embodiments.
Figure 4:
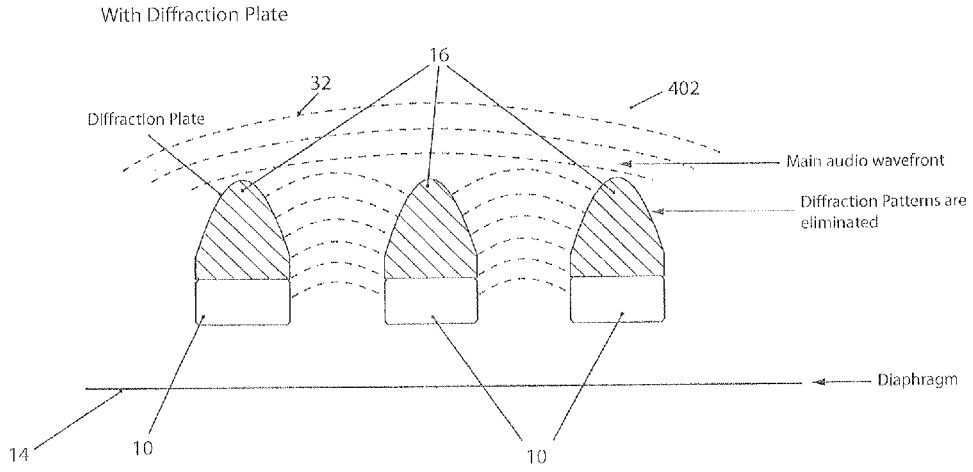

FIG. 4 illustrates two examples of portions of planar magnetic devices in operation, where view 400 shows the effect of the absence of any anti-diffraction structures on the magnets, and view 402 shows the effect of the anti-diffraction structures on the magnets. View 400 shows a main audio wavefront 26 traveling from diaphragm 14 of the planar magnetic device. As the wavefront 26 passes by the edges of the top of the magnets, the "corner" shape 30 of the magnets as seen in cross-section causes diffraction patterns 28 to be generated, and introduces distortion into the sound.

In contrast, view 402 shows a main audio wavefront 32 traveling from diaphragm 14 of the planar magnetic device. As wavefront 32 passes the combined structures of the anti-diffraction structures 16 positioned adjacent to the magnets, diffraction patterns are eliminated or minimized due to the surface shape of the anti-diffraction structures 16. The anti-diffraction structures 16 accordingly smooth out the "corner" shape of the of the magnets as seen in cross section, eliminating or reducing diffraction waves. The anti-diffraction structures 16 cause a smoother frequency response and a more precise imaging of the sound wave.

Figure 5:
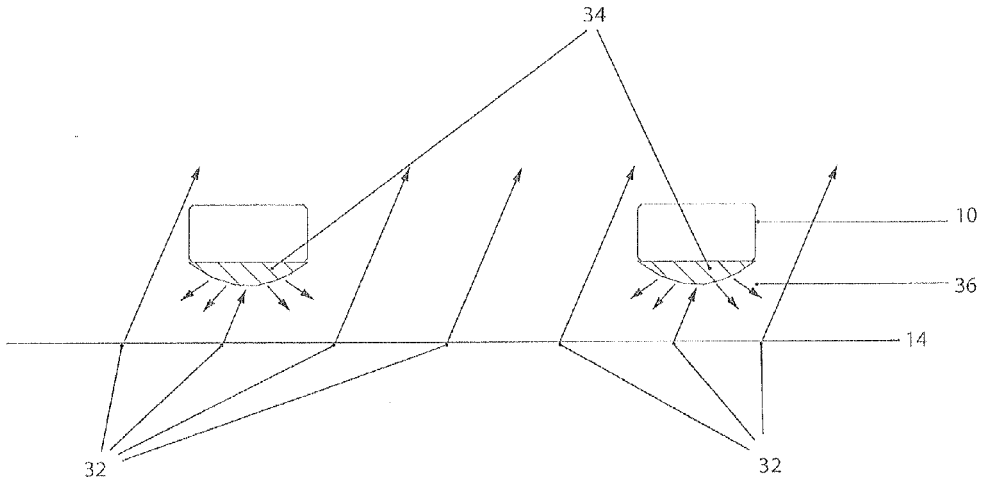
FIG. 5 is a diagram showing the movement and diffusion of sound waves with a diffusion structure, in accordance with some embodiments.

In addition to distortion of the sound waves from the diaphragm caused by diffraction as described above, sound waves of a particular wavelength may be reflected off the surface of the magnet facing the diaphragm, interfering with oncoming sound waves generating from the moving diaphragm. FIG. 5 is a diagram showing diffusion structures 34 that diffuse the power of the reflections to minimize the interference caused by reflection. As sound waves 32 travel from the diaphragm 14, they encounter the bottom surface of the magnet array 10 as shown. Diffusion structures which provides a curvature or other diffusing surface to the bottom magnet surface diffuses the reflected sound pressure waves in different directions, shown as diffused waves 36, greatly reducing or eliminating their power and capacity to create interference patterns with oncoming sound waves. In some embodiments, the long bar magnets are manufactured or shaped with diffusion structures 36. In some embodiments, the diffusion structures are mounted adjacent to the bottom surface of the magnets as shown.

Figure 6:
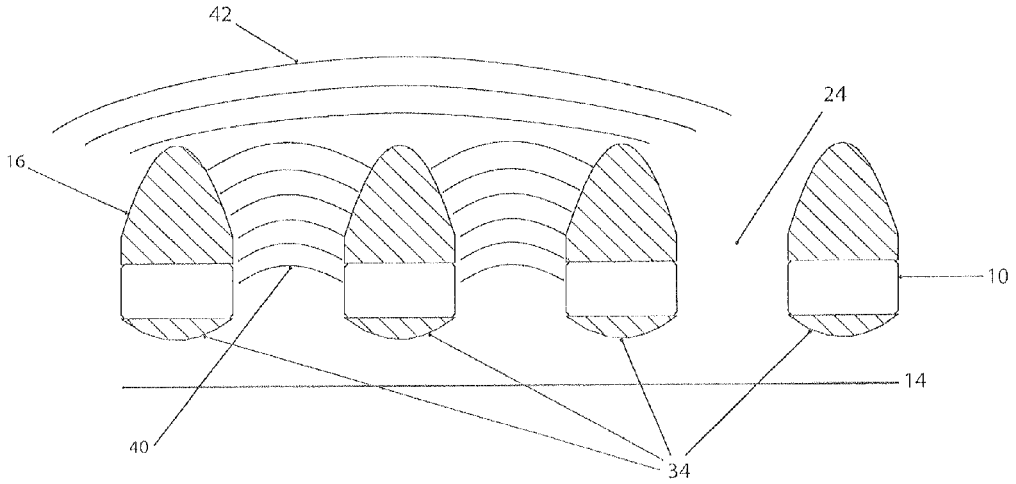
FIG. 6 is a diagram showing a more uniform wavefront emitted from a planar magnetic transducer with anti-diffraction plate and diffusion structures, in accordance with some embodiments.

FIG. 6 is a diagram illustrating a planar magnetic transducer having both an anti-diffraction plate with diffusion structures for creating a uniform wavefront. Sound waves generated from moving diaphragm 14 travel and encounter diffusion structures 34, apertures 24, and anti-diffraction wave guide structures. Due to the diffusion of reflected waves caused by diffusion structures 34, and the elimination of diffraction patterns from the presence of the anti-diffraction structures, a generally uniform wavefront 42 emerges from the apertures of the magnet array 10.

Figure 7:
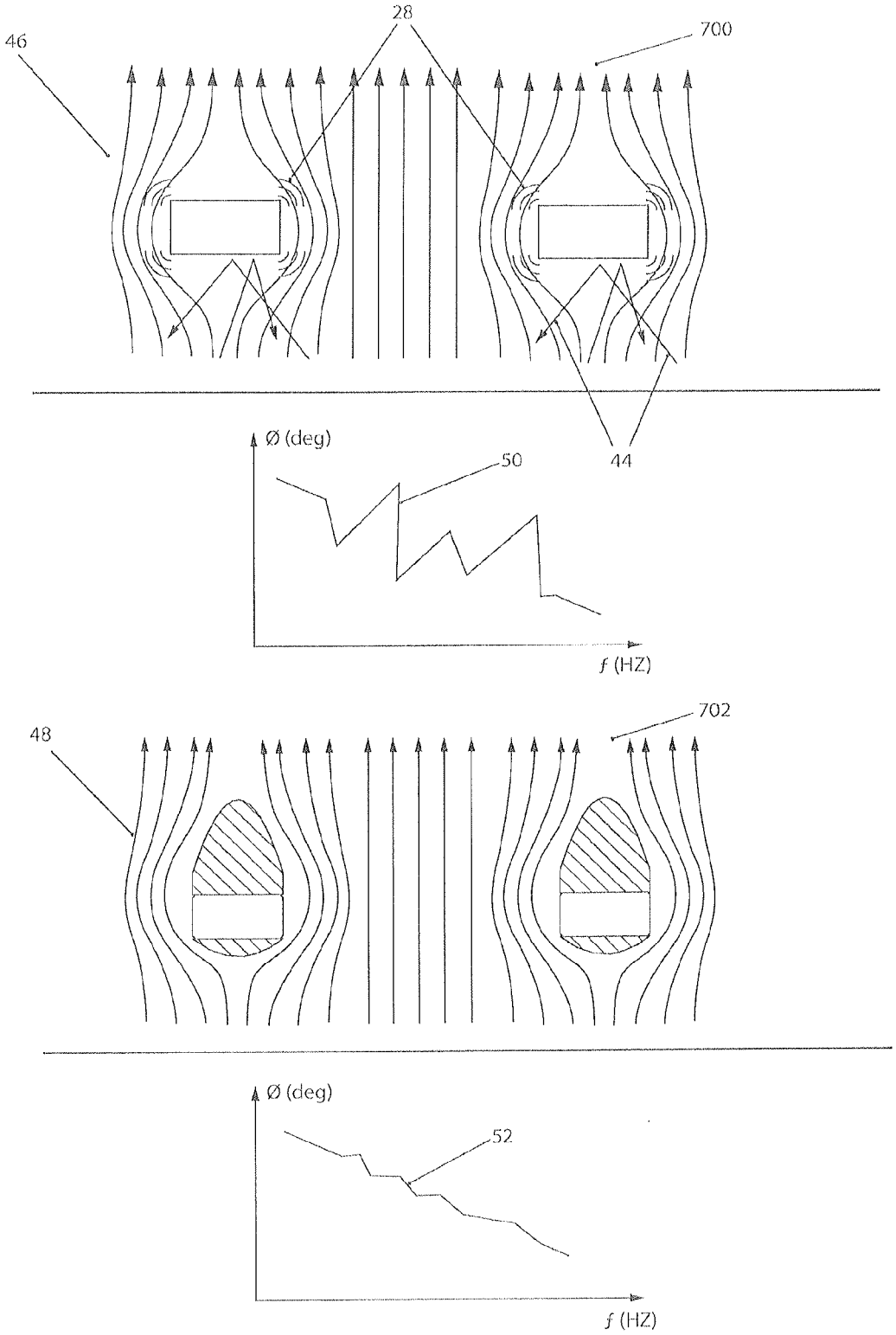
FIG. 7 is a diagram showing an uneven phase response in sound waves emitted from a planar magnetic transducer without any anti-diffraction plate or diffusion structure, in comparison with an even phase response in sound waves emitted from a planar magnetic transducer with the anti-diffraction plate constructed in accordance with some embodiments.

FIG. 7 are a set of diagrams illustrating a comparison between the phase response of sound waves passing through a planar magnetic transducer 700 with a standard long bar magnet array, and the phase response of sound waves passing through a planar magnetic transducer 702 with a modified long bar magnet array with the structures as described in FIGS. 1 to 6 above. When diffraction patterns 28 and reflected sound waves 44 occur, sound waves 46 are not smooth and do not provide a smooth phase response 50. In contrast, when diffraction patterns are reduced or eliminated, and the reflected sound waves are diffused, as shown with planar magnetic transducer 702, sound waves 48 are smooth and provide a smooth phase response 52.

Figure 8:
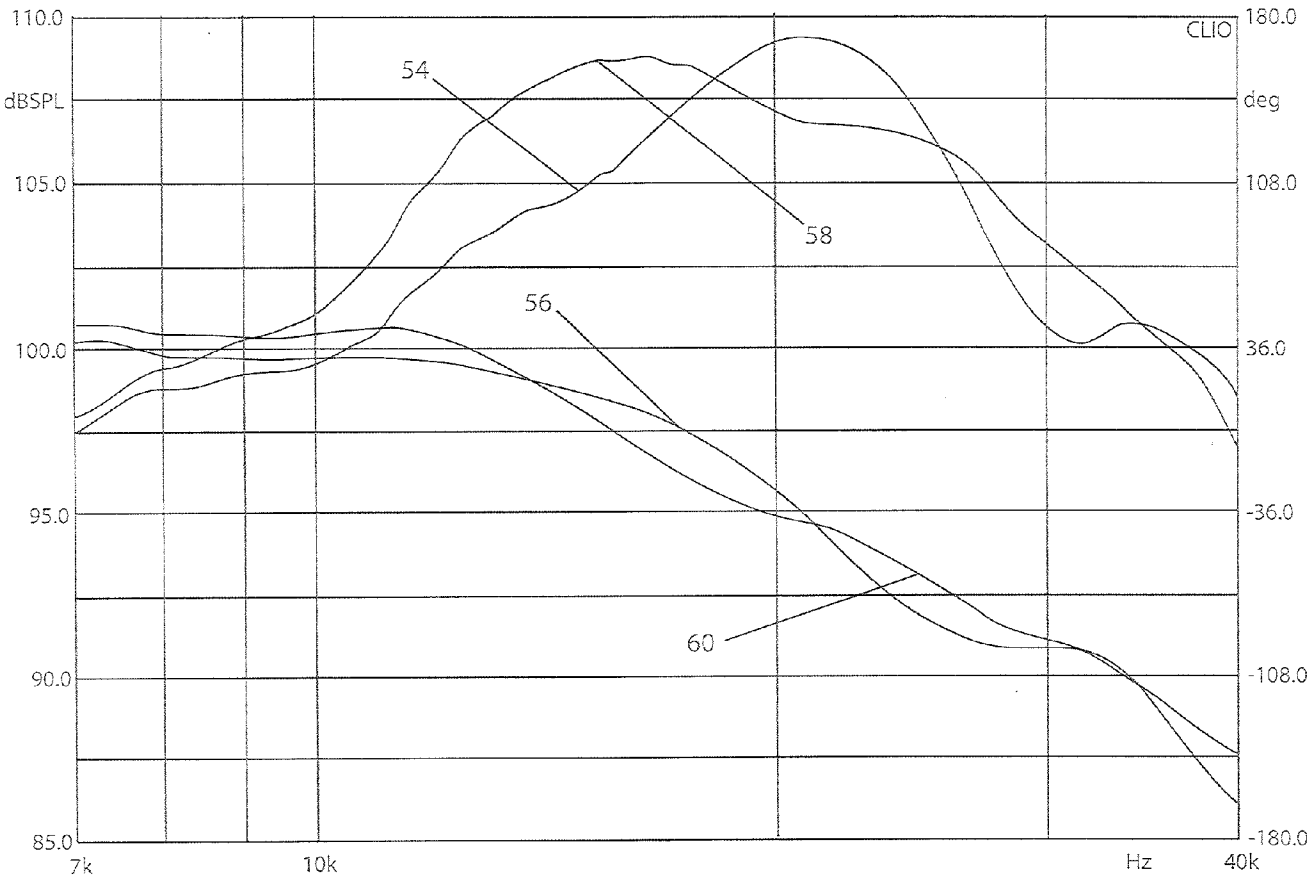
FIG. 8 is a graph illustrating a frequency and phase response in sound waves emitted from a planar magnetic transducer without any anti-diffraction plate or diffusion structure, in comparison with a frequency and phase response in sound waves emitted from a planar magnetic transducer with the anti-diffraction plate constructed and diffusion structure in accordance with some embodiments.

FIG. 8 is a graph illustrating a frequency and phase response in sound waves emitted from a planar magnetic transducer without any anti-diffraction plate or diffusion structure, in comparison with a frequency and phase response in sound waves emitted from a planar magnetic transducer with the anti-diffraction plate constructed and diffusion structure in accordance with some embodiments. FIG. 8 shows a graph having frequency response line 54 and phase response line 56 produced by a planar transducer without any anti-diffraction or diffusion structures, in contrast with frequency response line 58 and phase response line 60, produced by planar magnetic transducer according to some embodiments of the invention having anti-diffraction and diffusions structures. With use of anti-diffraction and diffusions structures in the planar magnetic transducers in accordance with some embodiments, frequency response is smoother, has higher efficiency and better extension than without the novel structures, and a near-linear phase response.

Other features, aspects and objects of the invention can be obtained from a review of the figures and the claims. It is to be understood that other embodiments of the invention can be developed and fall within the spirit and scope of the invention and claims.

The foregoing description of preferred embodiments of the present invention has been provided for the purposes of illustration and description. It is not intended to be exhaustive or to limit the invention to the precise forms disclosed. Various additions, deletions and modifications are contemplated as being within its scope. The scope of the invention is, therefore, indicated by the appended claims rather than the foregoing description. Further, all changes which may fall within the meaning and range of equivalency of the claims and elements and features thereof are to be embraced within their scope.

What is claimed is:

1. A magnet assembly for a planar magnetic transducer with improved frequency response and phase linearity, the magnet assembly comprising:

a first array of more than two bar magnets, the bar magnets arranged in parallel and evenly spaced, each bar magnet having four faces comprising:

a flat first, second, and third face, and a fourth face, each of the first and second faces perpendicular to a plane of the first array and parallel to a long axis of the corresponding bar magnet, the third face parallel to the plane and the long axis; and a second array of anti-diffraction structures in alignment with the first array, each anti-diffraction structure aligned with a corresponding magnet of the first array, each anti-diffraction structure having two faces comprising:

a flat fifth face and a curved sixth face, the fifth face in contact with the third face of the corresponding magnet, the sixth face facing away from the corresponding magnet, whereby a gap between adjacent magnets is constant and the gap between adjacent anti-diffraction structures increases with distance from the magnets.

2. The magnet assembly of claim 1, wherein the fourth face is flat.

3. The magnet assembly of claim 2 further comprising:

a third array of diffusion structures in alignment with the first array, each diffusion structure aligned with a corresponding magnet of the first array, each diffusion structure having two faces comprising:

a flat seventh face and a curved eighth face, the seventh face in contact with the fourth face of the corresponding magnet, the eighth face facing away from the corresponding magnet, wherein a curvature of the eighth face perpendicular is less than a curvature of the fifth face, the curvatures taken in a cross-section perpendicular to a long axis of the corresponding bar magnet.

4. The magnet assembly of claim 1, wherein the fourth face of each bar magnet is curved and wherein the fourth face is convex and a curvature of the fourth face is less than a curvature of the fifth face, the curvatures taken in a cross-section perpendicular to a long axis of the corresponding bar magnet.

5. The magnet assembly of claim 1, wherein the cross-sectional shape of each anti-diffraction structure has an exponential profile.

6. A planar magnetic transducer with improved frequency response and phase linearity, the transducer comprising:

a first array of more than two bar magnets, the bar magnets arranged in parallel and evenly spaced, each bar magnet having four faces comprising:

a flat first, second, and third face, and a fourth face, each of the first and second faces perpendicular to a plane of the first array and parallel to a long axis of the corresponding bar magnet, the third face parallel to the plane and the long axis;

a second array of anti-diffraction structures in alignment with the first array, each anti-diffraction structure aligned with a corresponding magnet of the first array, each anti-diffraction structure having two faces comprising:

a flat fifth face and a curved sixth face, the fifth face in contact with the third face of the corresponding magnet, the sixth face facing away from the corresponding magnet; and a diaphragm, the diaphragm held in tension parallel to the plane, the diaphragm separated from the first array, nearest the fourth faces of the bar magnets, by a first gap, the diaphragm having a conductive circuit pattern aligned with the bar magnets to create forces that move the diaphragm when energized, whereby a gap between adjacent magnets is constant and the gap between adjacent anti-diffraction structures increases with distance from the magnets.

7. The transducer of claim 6, wherein the fourth faces is flat.

8. The transducer of claim 7, further comprising:

a third array of diffusion structures in alignment with the first array, each diffusion structure aligned with a corresponding magnet of the first array, each diffusion structure having two faces comprising:

a flat seventh face and a curved eighth face, the seventh face in contact with the fourth face of the corresponding magnet, the eighth face facing away from the corresponding magnet, the diffusion structures not anywhere closing the first gap, wherein a curvature of the eighth face is less than a curvature of the fifth face, the curvatures taken in a cross-section perpendicular to a long axis of the corresponding bar magnet.

9. The transducer of claim 6, wherein the fourth face of each bar magnet is curved and wherein the fourth face is convex and a curvature of the fourth face is less than a curvature of the fifth face, the curvatures taken in a cross-section perpendicular to a long axis of the corresponding bar magnet.

10. The transducer of claim 6, wherein the cross-sectional shape of each anti-diffraction structure has an exponential profile.

* * * * *